United States Patent [19]

Pejsa

[11] Patent Number: 4,776,279

[45] Date of Patent: Oct. 11, 1988

[54] EXPANDING BALLISTIC PROJECTILE

[76] Inventor: Arthur J. Pejsa, 2120 Kenwood Pkwy., Minneapolis, Minn. 55408

[21] Appl. No.: 97,698

[22] Filed: Sep. 17, 1987

[51] Int. Cl.[4] ..... F42B 11/10

[52] U.S. Cl. ..... 102/510; 102/514

[58] Field of Search ..... 102/507–510, 102/514–516, 501

[56] References Cited

U.S. PATENT DOCUMENTS

| | | | |
|---|---|---|---|
| 376,302 | 1/1888 | Gregg | 102/92.2 |
| 594,199 | 11/1897 | Field | 102/91 |
| 1,095,502 | 5/1914 | Hoagland | 102/91 |
| 1,099,298 | 6/1914 | Hoagland | 102/91 |
| 1,114,356 | 10/1914 | Hoagland | 102/91 |
| 1,141,212 | 6/1915 | Ross | 102/509 |
| 1,155,901 | 10/1915 | Duncan | 102/91 |
| 1,493,614 | 5/1924 | Dickerman | 102/510 |
| 1,715,788 | 6/1929 | Rousseau | 102/91 |
| 2,045,964 | 6/1936 | Rinkel | 102/91 |
| 3,138,102 | 6/1964 | Meyer et al. | 102/92.5 |
| 3,142,256 | 7/1964 | Mack | 102/92.5 |
| 3,345,949 | 10/1967 | Nosler | 102/92.2 |
| 3,348,486 | 10/1967 | Rapp | 102/507 |
| 3,427,976 | 2/1969 | Lucy | 102/91 |
| 3,756,158 | 9/1973 | Anderson | 102/91 |
| 3,762,329 | 10/1973 | Mawhinney | 102/42 C |
| 3,881,421 | 5/1975 | Burczynski | 102/92.2 |
| 4,245,557 | 1/1981 | Knappworst et al. | 102/508 |

FOREIGN PATENT DOCUMENTS

| | | | |
|---|---|---|---|
| 2028238 | 12/1971 | Fed. Rep. of Germany | 102/514 |

*Primary Examiner*—Harold J. Tudor

*Attorney, Agent, or Firm*—Charles G. Mersereau

[57] ABSTRACT

An improved expanding ballistic projectile is disclosed which has an inner core of dense relatively soft, deformable material, and an outer jacket of malleable material. A central axial recess is provided in the nose portion of the inner core and a central opening is provided in the nose of the outer jacket coincident with the recess in the inner core. A generally cylindrical expansion-initiating insert member, having a generally symmetrically tapered rear portion and a generally symmetrically tapered nose portion and of a hardness greater than the inner core, is disposed in the recess. This cooperates with a plurality of circumferentially spaced longitudinal slits formed in the outer jacket to achieve controlled uniform expansion upon impact.

6 Claims, 1 Drawing Sheet

EXPANDING BALLISTIC PROJECTILE

BACKGROUND OF THE INVENTION

1. Field of the Invention

The present invention relates generally to impact expanding projectiles and, more particularly, to bullets with improved expansion characteristics which enable them to more closely resemble "ideal" hunting bullets.

There are several key features which are desired in bullets used for hunting big game or the like. They should have an aerodynamically efficient shape to produce true flight characteristics when fired. The ability to expand or flatten out upon impact with an objective is also highly desired to maximize tissue damage and shock. It is this latter characteristic which has been found to be the most difficult to perfect. The goal has been a controlled radial expansion with controlled deformation which is uniformly predictable notwithstanding typical variations in bullet impact speed and target composition or hardness. The complexity is further compounded by the need to maintain projectile integrity when engaging a target such that bullet disintegration or fragmentation is minimized or prevented during deformation. This has been especially difficult with respect to impact with relatively hard, boney material. Finally, the point of the projectile which commonly protrudes from the cartridge must be able to survive the rough handling associated with being carried and loaded into the firearm under the conditions of the hunt.

2. Description of the Prior Art

Methods for addressing the above objectives have resulted in an evolution of bullets which have a relatively hard covering or jacket partially or completely enclosing a soft core material in a variety of ways. One approach is the so called "mushrooming" bullet. In that design, the jacket does not completely encompass the nose of the core. The jacket is designed to collapse upon impact in a manner which causes the jacket to open radially at the nose, fold outwardly and peel back under the deforming exposed soft core material so that the bullet, in effect mushrooms upon impact. The nose usually is soft and may have a "hollow point" or an "insert", or other aids to initiating this outward radial expansion and mushrooming.

In an alternate approach, the nose itself is hard and does not deform. The jacket is weakened for a longitudinal span behind the nose. Upon impact the nose is pushed rearward and the projectile is caused to expand radially in an "accordian" fashion in the vicinity of the weakened portion of the jacket. The accordian type approach to collapsing deformation has provided some improvement in control of and reduced variation in radial expansion of the bullet, in response to variations in bullet speed and/or target composition and hardness in comparison to the mushroom approach. Also, this approach offers protection for the soft core material after impact and the bullet is thus less likely to disintegrate or lose as much of its mass on impact with typical targets. The tip of exposed soft core material associated with the mushroom approach often disintegrates or fragments upon impact and is more easily damaged or deformed during handling or loading which can seriously affect bullet aerodynamics.

Prior art designs which employ mushrooming type deformation are less desirable for most applications and generally inferior to the accordian expansion concepts, of which the present invention represents an improvement, and need not be addressed further. With respect to prior concepts in which the nose is not intended to mushroom, but expand in another manner, several prior art designs are believed to be of interest.

The first is found in U.S. Pat. No. 1,114,356 to Hoaglund. In Hoaglund the tip of the bullet is fully jacketed. The jacket is made in two parts, a nose portion and a body portion. The nose portion includes longitudinal grooves of a thinner section rearward of the nose itself which promote collapse upon impact. Upon impact, the nose section slides over the rear portion and expands "umbrella-like". Although this concept may serve certain applications, the unsupported rear of the resulting "umbrella" is also likely to collapse under stress. This impairs the ability of the bullet to retain and control sufficient radial expansion. In addition, a more conventional jacket of a single piece is less complex, and is easier and less costly to manufacture.

An early accordian concept employing a single piece jacket is found in U.S. Pat. No. 594,199 to Field. That design, however, lacks any additional means to facilitate nose collapse and expansion. Thus, deformation and expansion depend greatly upon target hardness. In cases of impact only with soft tissue or at slower speeds, the solid nose may well fail to collapse at all. It should be noted that the longated longitudinal holes around the projectile nose of Field are not 'slits', but rather 'cutouts' which are milled or ground into the nose. Their thin, knife-like borders are stated to be for a different purpose, presumably for cutting. Such gaping holes, however, also distort the desired aerodynamically smooth profile and weaken the nose jacket, exposing more soft core material, and rendering the nose more likely to burst or fracture upon impact with harder, boney target material.

A third design, found in U.S. Pat. No. 1,715,783 to Rousseau, exhibits an enclosed nose having a central longitudinal hole in the front of the nose, but that bullet is devoid of slits in the jacket to aid or control expansion. The "cannelure" at the base of the nose does not weaken the nose enough to ensure proper expansion upon impact with targets of varying hardness. In fact, the inventor even states that no appreciable distension will occur when the bullet is fired into a solid target such as wood and bone. The bullet will, therefore, pass clearly through such a solid target. Such non-expansion characteristics are not desired in accordance with the present invention.

U.S. Pat. No. 1,155,901 to Duncan discloses a hard nose insert. However, Duncan provides no jacket slits nor other means of weakening the jacket to aid or to control radial expansion. Again, as in Rousseau, it appears that in many situations, no radial expansion would take place. Moreover, upon impact with harder targets, where sufficient force is encountered, the jacket very easily could burst and ramdon expansion or even disintegration ensue. Because the insert is not cylindrical, it would also, apparently, be very difficult to insert into the nose making the bullet more difficult and costly to manufacture.

SUMMARY OF THE INVENTION

The present invention contemplates an improved projectile or bullet which, upon impact with a typical target, readily expands in a novel, predictable, controlled, accordian-like manner. The bullet of the invention combines controlled accordian-type outer jacket expansion initiated by controlled internal expansion of the deformable core. This controlled expansion is accomplished by a unique construction.

In the preferred embodiment, the jacket is provided with a plurality of circumferentially spaced longitudinal slits which weaken the sidewall and readily permit generally outward radial expansion. In addition, a longitudinal cylindrical cavity is formed in the nose of the jacket which extends partially into the core. A generally cylindrical, relatively hard, insert member with a symmetrically tapered rearward portion is contained firmly in the cavity. The frontal portion of the insert member is suitably pointed and protrudes smoothly from the nose of the bullet to provide an aerodynamic cone which cooperates with the nose of the jacket to provide an aerodynamically efficient nose contour for the projectile.

Upon impact with a target, the relative hard insert member makes the initial contact and is pushed rearward. The tapered rear portion penetrates and initiates the symmetrical radial expansion of the core. The initial radial expansion of the core occassioned by the rearward movement of the insert, in turn, exerts a radially directed force on the jacket. The jacket, weakened by the slits, then begins to expand, and as the jacket portion of the nose also impacts the target, regular accordian-type collapse occurs.

To promote expansion of only that portion of the jacket and core encompassed by the slits, the jacket may be thinned in selected places between the slits and thickened in section immediately fore and aft of the slits. This avoids further tearing of the jacket and loss of core material during expansion.

In an alternate embodiment of the invention, no insert member is placed in the aforementionned cavity; expansion is initiated on impact by pressure from the soft, moist target tissue.

DESCRIPTION OF THE PREFERRED EMBODIMENT

Figure 1:
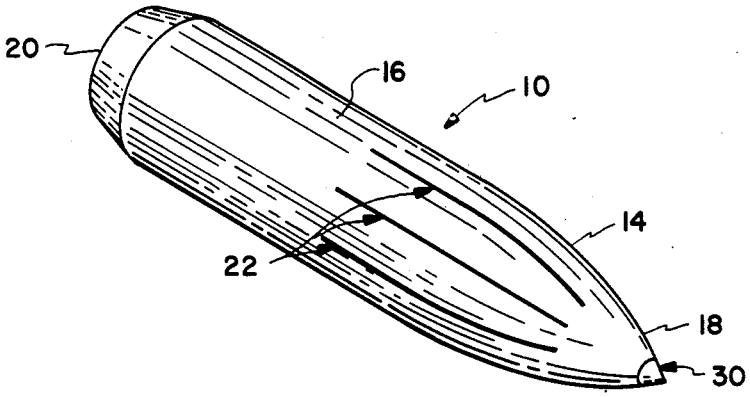
FIG. 1 is a perspective view, of one preferred embodiment of a projectile in accordance with the invention.
Figure 2:
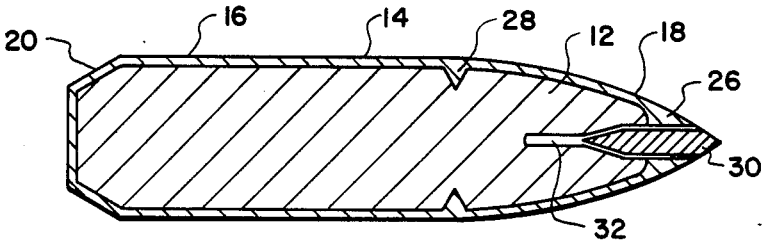
FIG. 2 is a longitudinal sectional view of the projectile of FIG. 1.

The preferred embodiment of the expanding bullet is presented in perspective and in section, respectively in FIGS. 1 and 2. The bullet, designated generally at 10, has a soft inner core 12 of suitable rather dense, pliable material such as lead alloy, and an outer jacket 14 of a harder suitable malleable or ductile material such as brass. The central body portion 16 is, generally cylindrical. The nose shape may be of any suitable aerodynamic design; the traditional ogive or arch shape shown at 18 is efficient and adequate both aerodynamically and for the deformation purposes of the invention. The rear part or tail 20 may be flat, rounded, or it may be tapered to improve aerodynamic efficiency, as shown in the figures.

A plurality of circumferentially spaced longitudinal slits 22 (FIG. 1) are formed in the jacket to permit ready radial expansion of that portion of the jacket between and along the slits and the corresponding portion of the core encompassed by the slits. Further control of this expansion may be achieved, if desired, by reducing the thickness of the portion of the jacket between the slits to further facilitate deformation. The jacket may also be made substantially thicker just fore and aft of the slits, as shown at 26 and 28 in FIG. 2, to avoid tearing of the jacket beyond the desired lontitudinal limits determined by the slit length.

Figure 3:
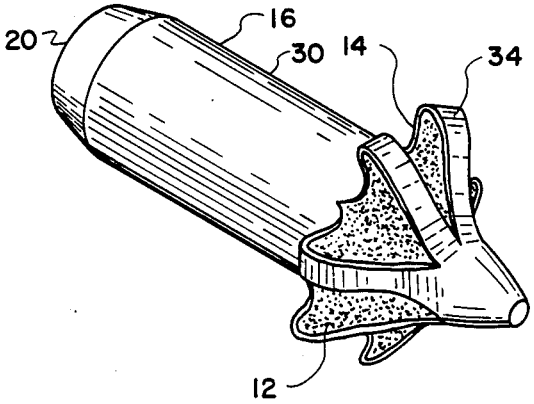
FIG. 3 approximates the projectile of FIG. 1 after encountering a target in post-impact expansion.

The radial spacing of the slits should be uniform to produce correspondingly uniform radial deformation upon impact. The slits 22 are preferably quite narrow and may be almost invisible to the naked eye. They are preferably made through the entire thickness of the jacket material. For certain applications, however, the slits may not extend through the entire jacket thickness. While symmetry is generally preferred, the number, length, depth and placement of the slits may be varied. Radial expansion is controlled and limited to that portion of the bullet encompassed by the slits. Even after expansion, the soft core material is contained by the expanded jacket material as shown in FIG. 3. This minimizes the likelihood of fragmentation or disintegration of the bullet.

A longitudinal cavity or hole is provided in the center, of the nose of the projectile, extending partially into the nose core. A concentric coincident opening is also provided in the jacket. A generally cylindrical insert 30 is disposed firmly in the nose cavity, as shown in FIG. 3. The rear of this insert is suitably conically tapered to readily penetrate and expand the core as it is pushed back upon impact with a target. This provides uniform, symmetrical radial expansion of the core in conjunction with the accordian collapse of the jacket. The front of the insert 30, which generally protrudes from the nose of the bullet, is shaped to smoothly complete the aerodynamically efficient nose contour of the ballistic projectile as shown in FIG. 3.

The insert is of a suitably hard material so that its exposed tip is not readily deformed by rough handling, or on impact and so that its conical aft portion can easily penetrate and uniformly expand the core material. The insert may be made of a plastic material. To further ease penetration and expansion, the cavity or hole for the insert may be extended deeper into the core using a diameter smaller than that for the insert, as shown at 32 in FIG. 2.

As is the case with the number, length, and placement of the slits, the size and shape of the nose cavity and of the insert member, may be varied to enhance and control desired radial expansion for varying conditions such as differening bullet speeds or anticipated target hardness and composition.

FIG. 3 (with reference to FIG. 2) illustrates the deformation of the projectile of the invention upon impact with a typical target. The initial contact is made by the insert number 30 which is pushed rearward. The movement of the tapered rear portion of the insert member 30 initiates the expansion of the core. This, in turn, exerts sufficient radial force on the jacket to begin a symmetrical radial expansion of the jacket in view of the slits therein. This continues as the heavier nose 26 of the jacket also impacts the target. At this point and in this manner, the jacket material along and between the slits collapses generally in an accordian-like fashion. This produces "hinge-like" protrusions such as shown at 34 which still substantially surround the core material.

In accordance with the invention, this symmetrical collapse which results in the "hinge-like" protrusions is important because loss of core material during and after expansion is minimized. Also, the hinged sections comprise two jacket thicknesses and, therefore, are stronger and better able to maintain a greater radial cross sectional area during further penetration of the target by the collapsed or expanded bullet. In summary the foregoing novel combination of features permits the radial expansion to be greater, more controllable and more uniform than prior designs.

Figure 4:
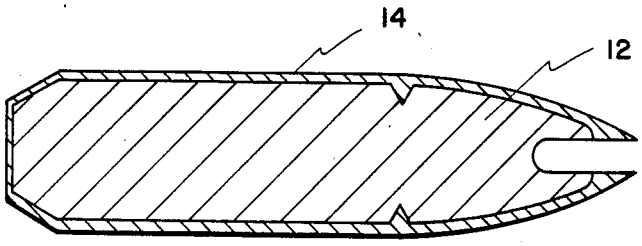
FIG. 4 is a longitudinal sectionnal view of an alternate embodiment of the invention.

FIG. 4 depicts a "hollow-point" or alternate version of the projectile of FIG. 1 which does not use the insert 30. This is a less expensive version which does not have the advantage of the combination effect of the insert. In this embodiment expansion is initiated solely by rearward pressure on the jacket nose.

It has been found that the combination of the longitudinal jacket slits and the conical insert obtains all the benefits of easy, controlled expansion without the drawbacks associated with loss of portions of the projectile or later collapse of the expanded projectile. Because the insert is tapered symmetrically and the jacket is of a single piece, manufacture is simplified and cost reduced.

What is claimed is:

1. An expanding ballistic projectile of the accordion-type having a nose, a tail, a longitudinal axis extending from said nose to said tail, a generally cylindrical rear portion and a front portion tapered from said rear portion to said nose comprising, in combination:

an inner core of relatively soft, deformable material;

an outer jacket of malleable material substantially completely enclosing said inner core;

a central, generally cylindrical axial recess in the nose portion of the inner core and a central opening in the nose of the outer jacket coincident with the axial recess in the inner core;

an expansion initiating insert member having a generally right circular cylindrical elongated central portion, a generally symmetrically tapered rear portion of gradually decreasing diameter and a generally symmetrically tapered nose portion of gradually decreasing diameter such that the maximum insert diameter occurs in said cylindrical central portion, and of a hardness greater than the inner core, nestled in said recess in the nose of the inner core and protruding therefrom in a manner such that the nose portion of the insert and the nose portion of the jacket cooperate to complete an aerodynamically efficient projectile nose contour, wherein the outer jacket is relatively heavier in gauge just fore and aft of said slits to enhance the uniform radial accordion-type expansion on impact; and a plurality of circumferentially spaced longitudinal slits formed in said outer jacket spaced in radial symmetry about the longitudinal axis and extending only partially intot he tapered front portion of the jacket, said slits cooperating with said insert member such that an accordion-type expansion occurs rearward of the nose portion upon impact, wherein the central axial recess in the inner core is extended beyond the depth necessary to accommodate the desired disposition of the insert member of facilitate rearward penetration of the inner core by the insert member upon impact.

2. The projectile of claim 1 wherein inner core consists substantially of a lead alloy and the outer jacket consists substantially of brass.

3. The projectile of claim 1 wherein the insert is of the same material as the outer jacket.

4. The projectile of claim 2 wherein the insert is of the same material as the outer jacket.

5. The projectile of claim 1 wherein the insert is a plastic material.

6. The projectile of claim 2 wherein the insert is a plastic material.

* * * * *